US007104764B2

(12) United States Patent
Lee et al.

(10) Patent No.: US 7,104,764 B2
(45) Date of Patent: Sep. 12, 2006

(54) VARIABLE CAPACITY ROTARY COMPRESSOR

(75) Inventors: In Ju Lee, Yongin (KR); Jun Young Lee, Yongin (KR); Dong Lyoul Shin, Suwon (KR); Seung Kap Lee, Suwon (KR); Cheol Woo Kim, Seongnam (KR); Valery Krasnoslobodtsev, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/807,285

(22) Filed: Mar. 24, 2004

(65) Prior Publication Data

US 2005/0002813 A1 Jan. 6, 2005

(30) Foreign Application Priority Data

Jul. 2, 2003 (KR) ..... 10-2003-0044463

(51) Int. Cl.
*F04B 49/00* (2006.01)

(52) U.S. Cl. ..... 417/218; 417/221; 417/326; 418/60; 418/63; 418/69; 418/109

(58) Field of Classification Search ..... 418/60, 418/63, 69, 23, 57, 109; 417/218, 221, 326
See application file for complete search history.

(56) References Cited

U.S. PATENT DOCUMENTS 713,301 A * 11/1902 Hagerty ..... 418/109
1,789,842 A * 1/1931 Rolaff ..... 418/63
5,236,318 A * 8/1993 Richardson, Jr. ..... 418/63
5,871,342 A 2/1999 Harte et al.
6,796,773 B1 * 9/2004 Choi et al. ..... 417/221
6,860,724 B1 * 3/2005 Cho et al. ..... 417/218

FOREIGN PATENT DOCUMENTS

JP 59063393 A * 4/1984
JP 05180183 A * 7/1993

* cited by examiner

*Primary Examiner*—Theresa Trieu
(74) *Attorney, Agent, or Firm*—Staas & Halsey LLP

(57) ABSTRACT

A variable capacity rotary compressor is designed to prevent eccentric bushes from slipping during a compression operation, thus preventing noise from being generated and increasing durability. The compressor includes a housing to define two compression chambers having different capacities therein. A rotating shaft is rotated in the compression chambers. Two eccentric cams are mounted to the rotating shaft. Two eccentric bushes are rotatably fitted over the eccentric cams. Two rollers are rotatably fitted over the eccentric bushes. Two vanes are installed in the compression chambers to be reciprocated in a radial direction of the rotating shaft. A cylindrical connecting part integrally connects the eccentric bushes to each other, with a locking slot being provided around the connecting part. A locking pin is mounted to the rotating shaft to project from the rotating shaft, and is locked by either of opposite ends of the locking slot, according to a rotating direction of the rotating shaft, thus making one of the eccentric bushes eccentric from the rotating shaft while making a remaining one of the eccentric bushes be released from eccentricity from the rotating shaft. A restraining unit outwardly moves from the rotating shaft by a centrifugal force when the rotating shaft is rotated, to restrain the connecting part.

14 Claims, 12 Drawing Sheets

VARIABLE CAPACITY ROTARY COMPRESSOR

CROSS-REFERENCE TO RELATED APPLICATIONS

This application claims the benefit of Korean Application No. 2003-44463, filed Jul. 2, 2003, in the Korean Intellectual Property Office, the disclosure of which is incorporated herein by reference.

BACKGROUND OF THE INVENTION

1. Field of the Invention

The present invention relates, in general, to rotary compressors and, more particularly, to a variable capacity rotary compressor which is capable of varying a capacity of compressing a refrigerant as desired.

2. Description of the Related Art

Generally, a compressor is installed in a refrigeration system, such as an air conditioner and a refrigerator, which functions to cool air in a given space using a refrigeration cycle. In the refrigeration system, the compressor functions to compress a refrigerant which circulates through a refrigeration circuit of the refrigeration system. A cooling capacity of the refrigeration system is determined according to a compression capacity of the compressor. Thus, when the compressor is constructed to vary the compression capacity thereof as desired, the refrigeration system may be operated under an optimum condition, according to a difference between an environmental temperature and a preset reference temperature, thus allowing air in a given space to be efficiently cooled, and saving energy.

In the refrigeration system have been used a variety of compressors, for example, rotary compressors, reciprocating compressors, etc. The present invention relates to the rotary compressor, which will be described in the following.

The conventional rotary compressor includes a hermetic casing, with a stator and a rotor being installed in the hermetic casing. A rotating shaft penetrates through the rotor. An eccentric cam is integrally provided on an outer surface of the rotating shaft. A roller is provided in a compression chamber to be fitted over the eccentric cam. The rotary compressor constructed as described above is operated as follows. As the rotating shaft rotates, the eccentric cam and the roller execute eccentric rotation in the compression chamber. At this time, a gas refrigerant is drawn into the compression chamber and then compressed, prior to discharging the compressed refrigerant to an outside of the hermetic casing.

However, the conventional rotary compressor has a problem in that the rotary compressor is fixed in a compression capacity thereof, so that it is impossible to vary the compression capacity according to a difference between an environmental temperature and a preset reference temperature.

In a detailed description, when the environmental temperature is considerably higher than the preset reference temperature, the compressor must be operated in a large capacity compression mode to rapidly lower the environmental temperature. Meanwhile, when the difference between the environmental temperature and the preset reference temperature is not large, the compressor must be operated in a small capacity compression mode so as to save energy. However, it is impossible to change the capacity of the rotary compressor according to the difference between the environmental temperature and the preset reference temperature, so that the conventional rotary compressor does not efficiently cope with a variance in temperature, thus leading to a waste of energy.

SUMMARY OF THE INVENTION

Accordingly, it is an aspect of the present invention to provide a variable capacity rotary compressor, which is constructed so that a compression operation is executed in either of two compression chambers having different capacities by an eccentric unit mounted to a rotating shaft, thus varying a compression capacity as desired.

It is another aspect of the present invention to provide a variable capacity rotary compressor, which is designed to prevent the eccentric unit from slipping during a compression operation, thus preventing noise from being generated and increasing durability.

Additional aspects and/or advantages of the invention will be set forth in part in the description which follows and, in part, will be obvious from the description, or may be learned by practice of the invention.

The foregoing and/or other aspects of the present invention are achieved by providing a variable capacity rotary compressor, including a housing, a rotating shaft, first and second eccentric cams, first and second eccentric bushes, first and second rollers, first and second vanes, a cylindrical connecting part, a locking pin, and a restraining unit. The housing defines first and second compression chambers having different capacities therein. The rotating shaft is rotated in the first and second compression chambers. The first and second eccentric cams are mounted to the rotating shaft to be placed in the first and second compression chambers, respectively. The first and second eccentric bushes are rotatably fitted over the first and second eccentric cams, respectively. The first and second rollers are rotatably fitted over the first and second eccentric bushes, respectively. The first vane is installed in the first compression chamber to be reciprocated in a radial direction of the rotating shaft while being in contact with the first roller, and the second vane is installed in the second compression chamber to be reciprocated in the radial direction of the rotating shaft while being in contact with the second roller. The cylindrical connecting part integrally connects the first and second eccentric bushes to each other, with a locking slot being provided around the connecting part. The locking pin is mounted to the rotating shaft to be projected from the rotating shaft, and is locked by either of first and second ends of the locking slot, according to a rotating direction of the rotating shaft. Thus, one of the first and second eccentric bushes is eccentric from the rotating shaft while a remaining one of the first and second eccentric bushes is released from eccentricity from the rotating shaft. In this case, the first and second eccentric bushes are eccentric in opposite directions. The restraining unit is fitted over the locking pin to be reciprocated in a radial direction of the rotating shaft, and outwardly moves from the rotating shaft by a centrifugal force when the rotating shaft is rotated, thus being stopped by either of the first and second ends of the locking slot to restrain the connecting part.

According to an aspect of the invention, the locking pin includes a head part which engages with the locking slot, and a locking part which extends from the head part to be mounted to the rotating shaft, and has a smaller diameter than the head part. The restraining unit includes a support part, and an extension part. In this case, the support part is fitted over the locking part of the locking pin to be reciprocated in the radial direction of the rotating shaft. The extension part outwardly extends from the support part in the radial direction of the rotating shaft to cover an outer surface of the head part of the locking pin, and enters the locking slot.

According to an aspect of the invention, the extension part extends from upper and lower portions of the support part to cover upper and lower surfaces of the head part of the locking pin. The locking slot has a width to correspond to a width of the head part, and a restraining recess provided at each of the first and second ends of the locking slot to have a depth to correspond to a thickness of the extension part, thus causing the extension part to be stopped within the restraining recess.

According to an aspect of the invention, an outer surface of the extension part has a curved surface to correspond to an inner surface of the restraining recess.

According to an aspect of the invention, a return spring is fitted over the locking part of the locking pin to bias the restraining unit toward a central axis of the rotating shaft when the rotating shaft is stopped, thus releasing the connecting part. A magnet is included in the rotating shaft to bias the restraining unit toward a central axis of the rotating shaft when the rotating shaft is stopped, thus releasing the connecting part.

According to an aspect of the invention, a locking hole is provided at a predetermined position of the rotating shaft to movably receive the restraining unit therein. An eccentric part, having a same shape as the eccentric cams, is provided on an outer surface of the rotating shaft inside the connecting part to mount the locking pin and the restraining unit to the rotating shaft.

The foregoing and/or other aspects of the present invention are achieved by providing a variable capacity rotary compressor, including a housing, a rotating shaft, first and second eccentric cams, first and second eccentric bushes, first and second rollers, first and second vanes, first and second locking pins, and first and second restraining units. The housing defines first and second compression chambers having different capacities therein. The rotating shaft is rotated in the first and second compression chambers. The first and second eccentric cams are mounted to the rotating shaft to be placed in the first and second compression chambers, respectively. The first and second eccentric bushes are rotatably fitted over the first and second eccentric cams, respectively, and are placed to be eccentric in opposite directions, with a locking slot provided around each of the first and second eccentric bushes. The first and second rollers are rotatably fitted over the first and second eccentric bushes, respectively. The first vane is installed in the first compression chamber to be reciprocated in a radial direction of the rotating shaft while being in contact with the first roller, and the second vane is installed in the second compression chamber to be reciprocated in the radial direction of the rotating shaft while being in contact with the second roller. The first and second locking pins are projected from the first and second eccentric cams, respectively. Each of the first and second locking pins is locked by either of first and second ends of an associated locking slot of the eccentric bushes, according to a rotating direction of the rotating shaft. Thus, one of the first and second eccentric bushes is eccentric from the rotating shaft while a remaining one of the first and second eccentric bushes is released from eccentricity from the rotating shaft. The first and second restraining units are fitted over the first and second locking pins, respectively, to be reciprocated in a radial direction of the eccentric cams, and outwardly move from the first and second eccentric cams, respectively, by a centrifugal force when the eccentric cams are rotated, thus restraining the first and second eccentric bushes.

BRIEF DESCRIPTION OF THE DRAWINGS

The above and/or other aspects and advantages of the invention will become apparent and more readily appreciated from the following description of the preferred embodiments, taken in conjunction with the accompanying drawings in which.

DETAILED DESCRIPTION OF THE PREFERRED EMBODIMENTS

Figure 1:
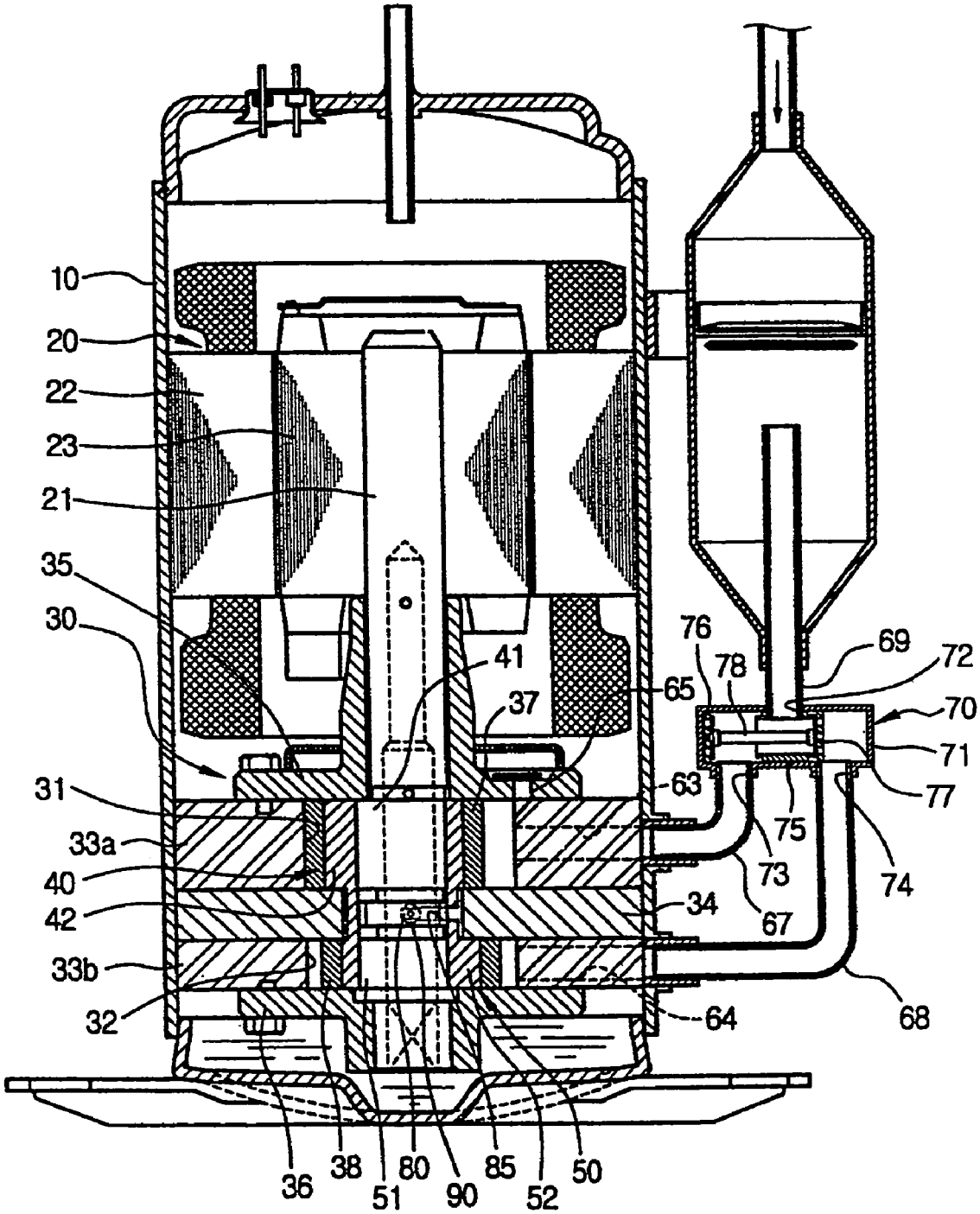
FIG. 1 is a sectional view illustrating a variable capacity rotary compressor, according to an embodiment of the present invention.

Reference will now be made in detail to the present preferred embodiments of the present invention, examples of which are illustrated in the accompanying drawings, wherein like reference numerals refer to like elements throughout.

As illustrated in FIG. 1, a variable capacity rotary compressor, according to the present invention includes a hermetic casing 10. A drive unit 20 is installed in the casing 10 to be placed on an upper portion of the casing 10, and generates a rotating force. A compressing unit 30 is installed in the casing 10 to be placed on a lower portion of the casing 10, and is connected to the drive unit 20 through the rotating shaft 21. The drive unit 20 includes a cylindrical stator 22, and a rotor 23. The stator 22 is mounted to an inner surface of the casing 10. The rotor 23 is rotatably and concentrically set in the stator 22, and is mounted to the rotating shaft 21 which is placed at a center of the casing 10. The drive unit 20 rotates the rotating shaft 21 forwards or backwards.

The compressing unit 30 includes upper and lower housings 33*a* and 33*b*, which define first and second compression chambers 31 and 32, respectively. The first and second compression chambers 31 and 32 are both cylindrical but have different capacities. An upper flange 35 is mounted to an upper surface of the upper housing 33*a* to close an upper portion of the first compression chamber 31, and a lower flange 36 is mounted to a lower surface of the lower housing 33*b* to close a lower portion of the second compression chamber 32. Further, the upper and lower flanges 35 and 36 function to rotatably support the rotating shaft 21. A partition plate 34 is interposed between the upper and lower housings 33*a* and 33*b*, to partition the first and second compression chambers 31 and 32 into each other.

Figure 2:
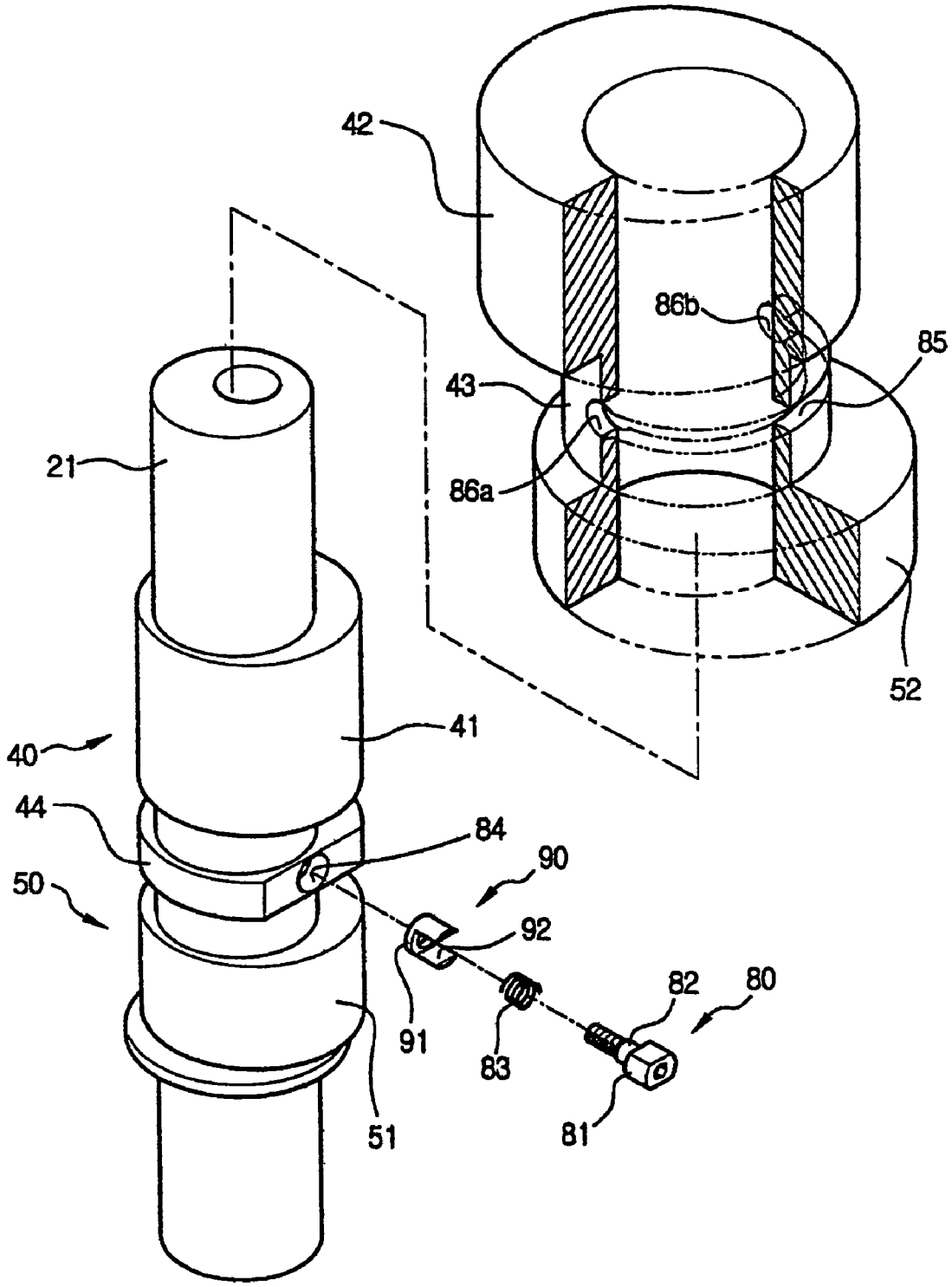
FIG. 2 is an exploded perspective view of an eccentric unit included in the variable capacity rotary compressor of FIG. 1.
Figure 3:
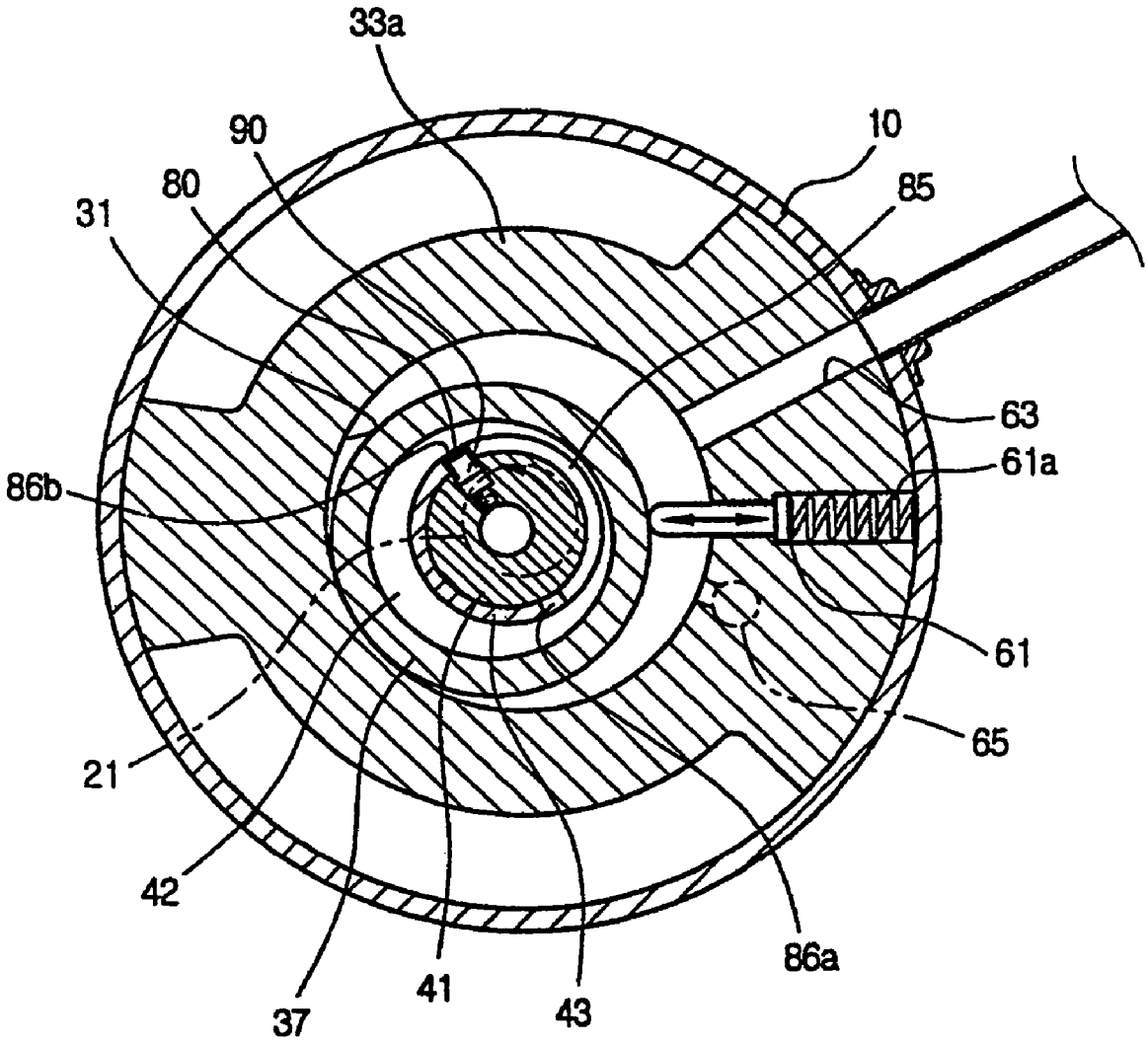
FIG. 3 is a sectional view illustrating a compression operation of a first compression chamber, when a rotating shaft of the variable capacity rotary compressor of FIG. 1 is rotated in a first direction.
Figure 4:
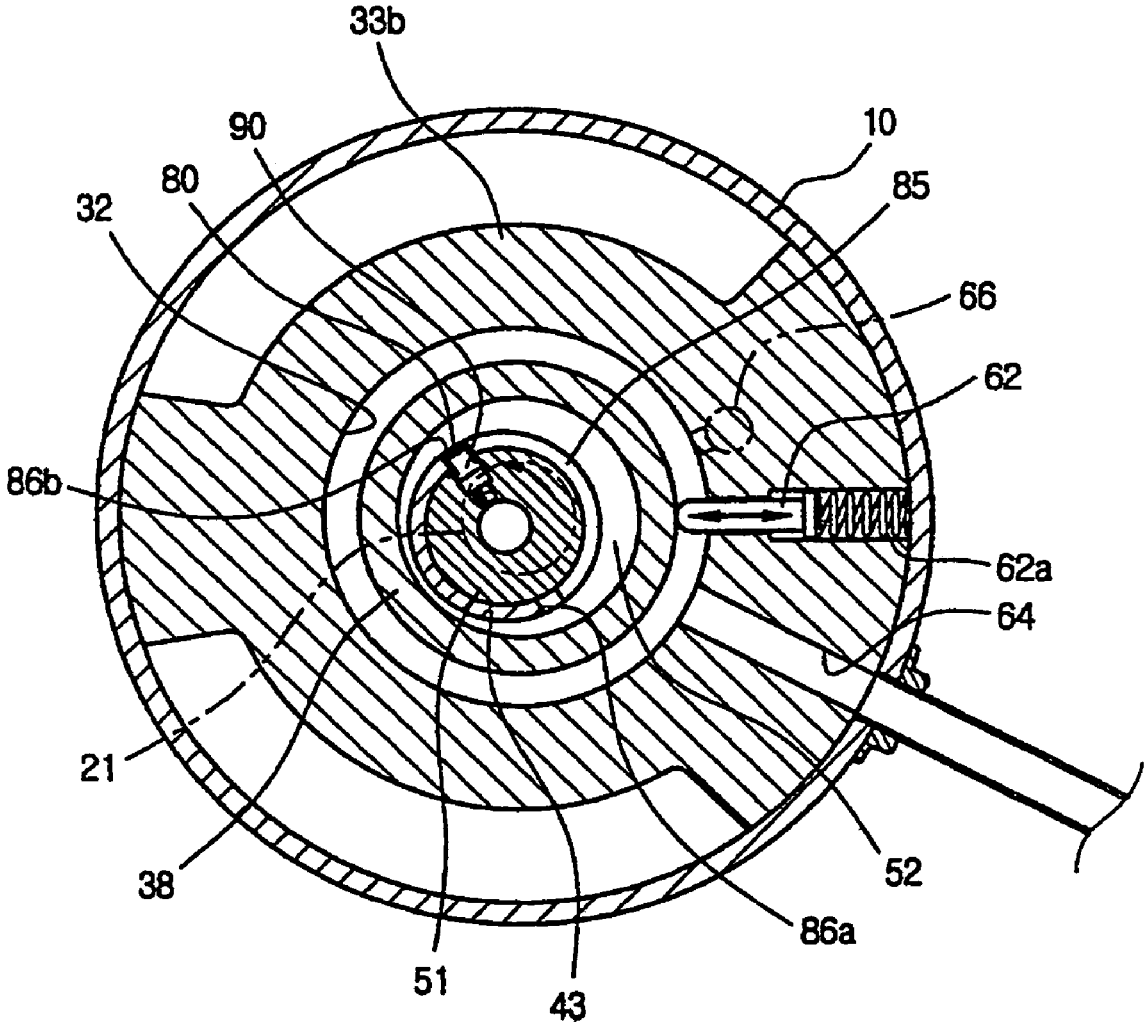
FIG. 4 is a sectional view illustrating an idle operation of a second compression chamber, when the rotating shaft of the variable capacity rotary compressor of FIG. 1 is rotated in the first direction.

As illustrated in FIGS. 2 through 4, first and second eccentric units 40 and 50 are mounted to the rotating shaft 21 to be placed in the first and second compression chambers 31 and 32, respectively. First and second rollers 37 and 38 are rotatably fitted over the first and second eccentric units 40 and 50, respectively. Further, a first vane 61 is installed between an inlet port 63 and an outlet port 65 of the first compression chamber 31, and reciprocates in a radial direction while being in contact with an outer surface of the first roller 37, thus performing a compression operation. A second vane 62 is installed between an inlet port 64 and an outlet port 66 of the second compression chamber 32, and reciprocates in the radial direction while being in contact with an outer surface of the second roller 38, thus performing a compression operation. The first and second vanes 61 and 62 are biased by vane springs 61*a* and 62*a*, respectively. Further, the inlet and outlet ports 63 and 65 of the first compression chamber 31 are arranged on opposite sides of the first vane 61. Similarly, the inlet and outlet ports 64 and 66 of the second compression chamber 32 are arranged on opposite sides of the second vane 62.

The first and second eccentric units 40 and 50 include first and second eccentric cams 41 and 51, respectively. The first and second eccentric cams 41 and 51 are mounted to an outer surface of the rotating shaft 21 to be placed in the first and second compression chambers 31 and 32, respectively, while being eccentric from the rotating shaft 21 in a same direction. First and second eccentric bushes 42 and 52 are rotatably fitted over the first and second eccentric cams 41 and 51, respectively. As illustrated in FIG. 2, the first and second eccentric bushes 42 and 52 are integrally connected to each other by a cylindrical connecting part 43, and are eccentric from the rotating shaft 21 in opposite directions. Further, the first and second rollers 37 and 38 are rotatably fitted over the first and second eccentric bushes 42 and 52, respectively.

As illustrated in FIG. 2, an eccentric part 44 is provided on an outer surface of the rotating shaft 21 between the first and second eccentric cams 41 and 51, and is eccentric from the rotating shaft 21 in a same direction as the eccentric cams 41 and 51. Further, a locking unit and a restraining unit 90 are installed between the eccentric part 44 and the connecting part 43. The locking unit functions to make one of the first and second eccentric bushes 42 and 52 be eccentric from the rotating shaft 21 while making a remaining one of the first and second eccentric bushes 42 and 52 be released from eccentricity from the rotating shaft 21, according to a rotating direction of the rotating shaft 21. The restraining unit 90 is outwardly projected from the rotating shaft 21 by a centrifugal force when the rotating shaft 21 is rotated, thus restraining the connecting part 43.

Figure 9:
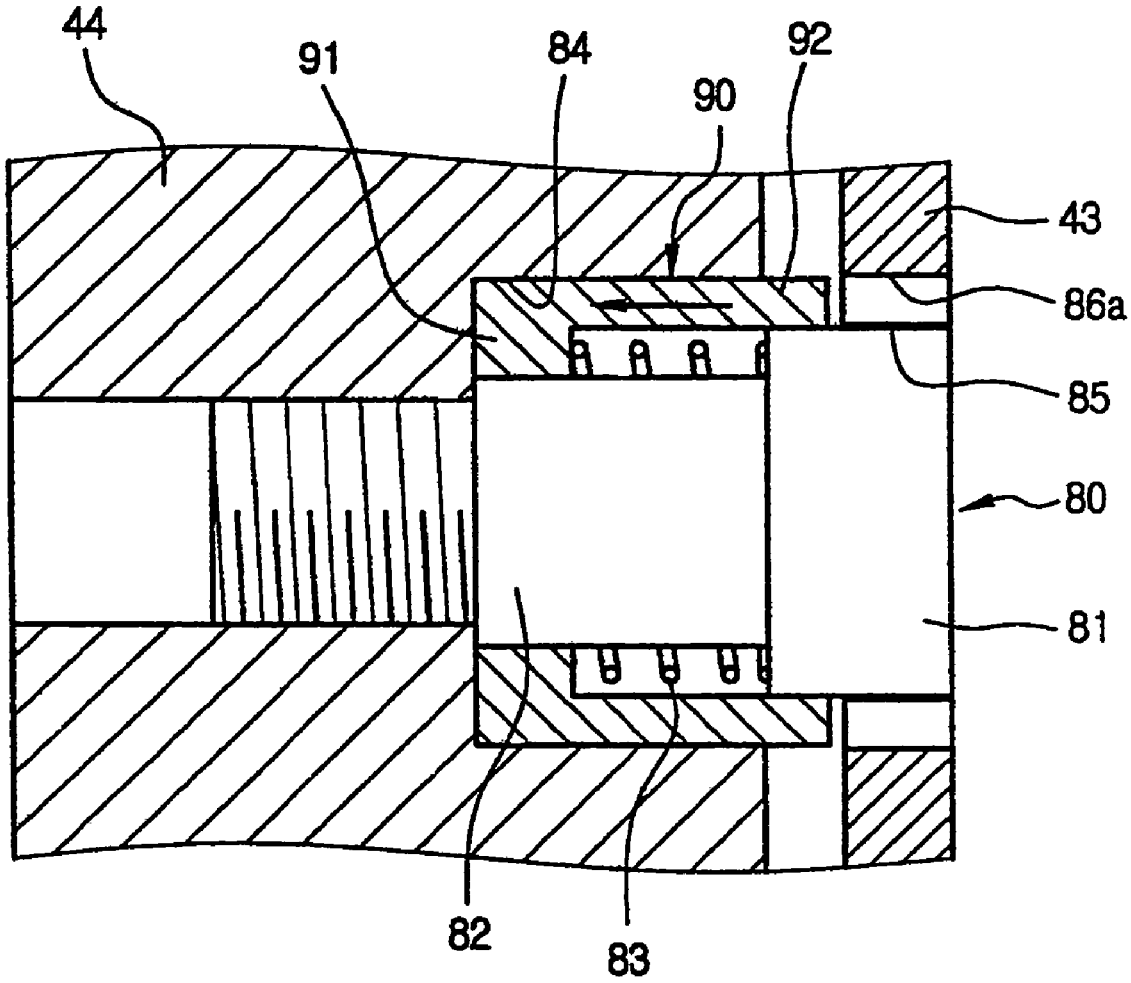
FIG. 9 is a sectional view illustrating the locking pin and the restraining unit of the variable capacity rotary compressor of FIG. 1, in which the connecting unit is released from the restraining unit.

As illustrated in FIGS. 2 and 9, the locking unit includes a locking pin 80, and a locking slot 85. The locking unit includes a locking pin 80 and a locking slot 85. The locking pin 80 is mounted to a flat surface of the eccentric part 44 in a screw-type fastening method to be projected from the flat surface of the eccentric part 44. The locking slot 85 is provided around a part of the connecting part 43 which connects the first and second eccentric bushes 42 and 52 to each other. The locking pin 80 engages with the locking slot 85 to make one of the first and second eccentric bushes 42 and 52 eccentric from the rotating shaft 21 while a remaining one of the first and second eccentric bushes 42 and 52 be released from eccentricity from the rotating shaft 21, according to a rotating direction of the rotating shaft 21. That is, when the rotating shaft 21 is rotated, the locking pin 80, mounted to the eccentric part 44 of the rotating shaft 21, engaging with the locking slot 85 of the connecting part 43, is rotated within the locking slot 85 to be locked by either of opposite ends of the locking slot 85, thus making the first and second eccentric bushes 42 and 52 be rotated along with the rotating shaft 21. Further, when the locking pin 80 is locked by either of the opposite ends of the locking slot 85, one of the first and second eccentric bushes 42 and 52 is eccentric from the rotating shaft 21 and a remaining one of the first and second eccentric bushes 42 and 52 is released from eccentricity from the rotating shaft 21, thus executing a compression operation in one of the first and second compression chambers 31 and 32, and executing an idle operation in a remaining one of the first and second eccentric bushes 42 and 52. On the other hand, when a rotating direction of the rotating shaft 21 is changed, the first and second eccentric bushes 42 and 52 are arranged oppositely to the above-mentioned state.

Further, as illustrated in FIG. 9, the locking pin 80 includes a head part 81 to engage with the locking slot 85, and a locking part 82. The locking part 82 extends from the head part 81 to be mounted to the eccentric part 44 of the rotating shaft 21 in a screw-type fastening method, and has a smaller diameter than the head part 81. A locking hole 84 is provided at a predetermined position of the eccentric part 44 of the rotating shaft 21, and has an inner diameter larger than an outer diameter of the head part 81 of the locking pin 80 to allow the locking pin 80 to be mounted to the eccentric part 44 while the locking part 82 of the locking pin 80 enters the locking hole 84. The restraining unit 90 is placed between the locking hole 84 and an outer surface of the locking part 82 of the locking pin 80 to be reciprocated in the radial direction of the rotating shaft 21, and functions to restrain the connecting part 43 when the locking pin 80 is locked by either of the opposite ends of the locking slot 85.

As illustrated in FIGS. 2 and 9, the restraining unit 90 includes an annular support part 91, and two extension parts 92. Here, the support part 91 is movably fitted over the locking part 82 of the locking pin 80. The extension parts 92 outwardly extend from the support part 91 in the radial direction of the rotating shaft 21 to cover outer flat surfaces of upper and lower portions of the head part 81 of the locking pin 80. Further, first and second restraining recesses

86*a* and 86*b* are provided at the first and second ends of the locking slot 85, respectively, to have a depth to correspond to a thickness of the extension parts 92, thus allowing the extension parts 92 to be stopped by either of the first and second restraining recesses 86*a* and 86*b*. That is, the locking slot 85 has a width to correspond to a width of the head part 81 of the locking pin 80. The first and second restraining recesses 86*a* and 86*b* are provided at the first and second ends of the locking slot 85, respectively, to allow the extension parts 92 of the restraining unit 90 to be stopped by either of the first and second restraining recesses 86*a* and 86*b*.

Further, the upper and lower portions of the head part 81 of the locking pin 80, which are in contact with inner surfaces of the extension parts 92 of the restraining unit 90, are designed to be flat, and the inner surfaces of the extension parts 92 are also designed to be flat, thus allowing the restraining unit 90 to be smoothly reciprocated in the radial direction of the rotating shaft 21, and allowing the head part 81 of the locking pin 80 to be in close contact with the extension parts 92 of the restraining unit 90. The restraining unit 90 is designed to have a cylindrical outer surface. Each of the first and second restraining recesses 86*a* and 86*b* is designed to have a shape to correspond to the shape of the outer surface of the restraining unit 90.

The restraining unit 90 as described above, is operated as follows. That is, by the centrifugal force, when the rotating shaft 21 is rotated, the restraining unit 90 outwardly moves from the rotating shaft 21 to engage with either of the first and second restraining recesses 86*a* and 86*b*, which are provided at the first and second ends of the locking slot 85, thus restraining the connecting part 43 connected to the first and second eccentric bushes 42 and 52, during the rotating of the rotating shaft 21.

Further, a return spring 83 is placed between an outer surface of the locking part 82 of the locking pin 80 and inner surfaces of the extension parts 92 of the restraining unit 90, thus biasing the restraining unit 90 toward a central axis of the rotating shaft 21 when the rotating shaft 21 is not rotated. The return spring 83 is a compression coil spring, which is fitted over the locking part 82 of the locking pin 80. The return spring 83 is supported at a first end thereof by the head part 81 of the locking pin 80, and is supported at a second end thereof by the support part 91 of the restraining unit 90, to allow the restraining unit 90 to be biased toward the central axis of the rotating shaft 21. Thus, when the rotating shaft 21 stops rotating and there is no centrifugal force, the extension parts 92 of the restraining unit 90 are disengaged from either of the first and second restraining recesses 86*a* and 86*b* by a restoring force of the return spring 83, releasing the connecting part 43.

Figure 11:
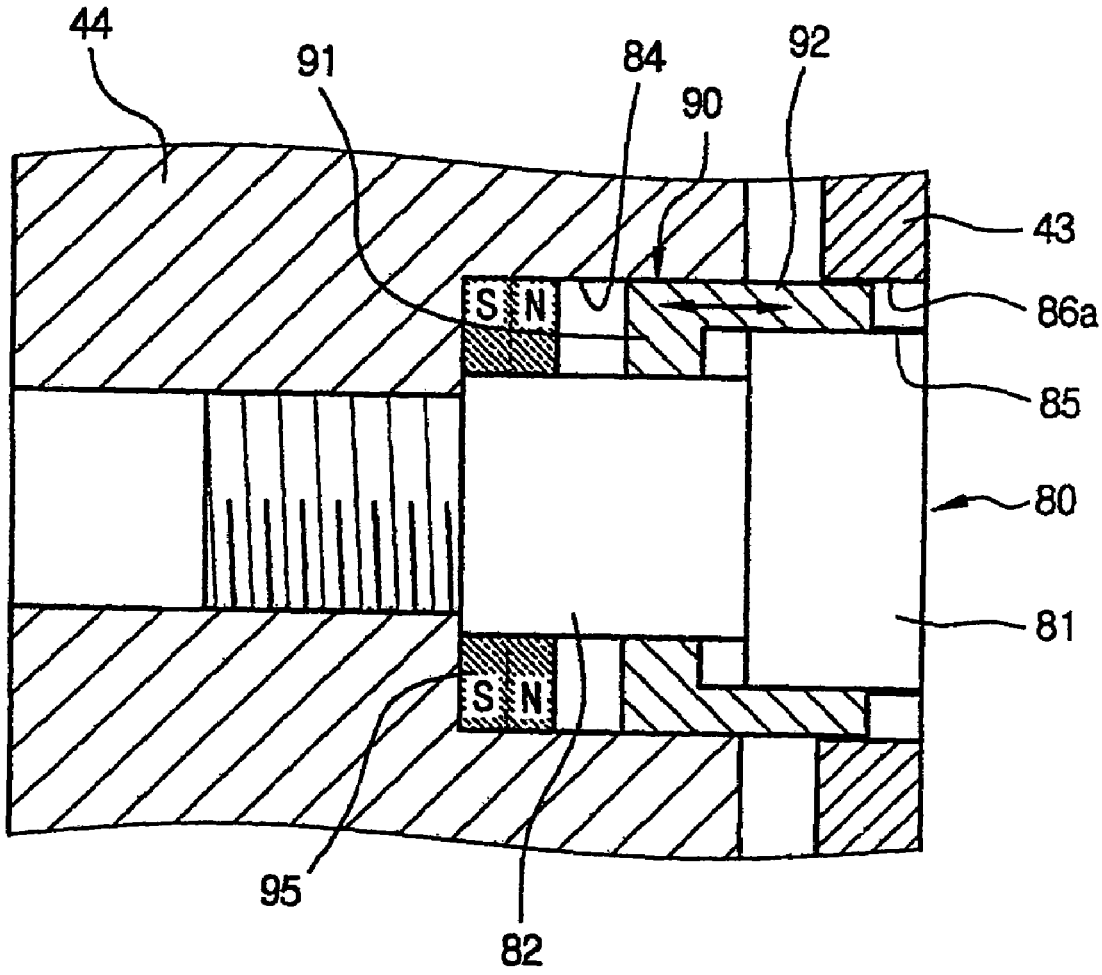
FIG. 11 is a sectional view illustrating a locking pin and a restraining unit included in a variable capacity rotary compressor, according to another embodiment of the present invention.

According to another embodiment of the present invention, as shown in FIG. 11, a magnet 95 is used to release the connecting part 43, in place of the return spring 83. The magnet 95 is installed at a position inside the locking hole 84 which receives the restraining unit 90. The restraining unit 90 is movably fitted over the locking part 82 of the locking pin 80. According to this embodiment, when the rotating shaft 21 is not rotated, the restraining unit 90 is pulled to the magnet 95. Meanwhile, as the centrifugal force increases by the rotation of the rotating shaft 21, the restraining unit 90 is pulled away from the magnet 95 and moves outwardly in the radial direction of the rotating shaft 21, thus restraining the connecting part 43. Thereafter, when the rotating shaft 21 stops rotating again, the restraining unit 90 moves toward the central axis of the rotating shaft 21 by an attractive force of the magnet 95, thus releasing the connecting part 43.

As illustrated in FIG. 1, the variable capacity rotary compressor also includes a path control unit 70. The path control unit 70 controls a refrigerant intake path to make a refrigerant fed from a refrigerant inlet pipe 69 be drawn into the inlet port 63 of the first compression chamber 31 or the inlet port 64 of the second compression chamber 32 (that is, the inlet port of a compression chamber where the compression operation is executed).

The path control unit 70 includes a hollow cylindrical body 71, and a valve unit installed in the body 71. An inlet 72 is provided at a central portion of the body 71 to be connected to the refrigerant inlet pipe 69. First and second outlets 73 and 74 are provided on opposite sides of the body 71. Two pipes 67 and 68, which are connected to the inlet port 63 of the first compression chamber 31 and the inlet port 64 of the second compression chamber 32, respectively, are connected to the first and second outlets 73 and 74, respectively. Further, the valve unit includes a valve seat 75, first and second valve members 76 and 77, and a connecting member 78. The valve seat 75 has a cylindrical shape, and is opened at both ends thereof. The first and second valve members 76 and 77 are installed on both sides in the body 71, and axially reciprocate in the body 71 to open or close both ends of the valve seat 75. The connecting member 78 connects the first and second valve members 76 and 77 to each other to allow the first and second valve members 76 and 77 to move together. In this case, the path control unit 70 is operated as follows. When the compression operation is executed in either of the first and second compression chambers 31 and 32, the first and second valve members 77 set in the body 71 move in a direction toward one of the two outlets 73 and 74 having a lower pressure due to a difference in pressure between the two outlets 73 and 74, thus automatically changing a refrigerant intake path.

The operation of the variable capacity rotary compressor according to the present invention, will be described as follows.

As illustrated in FIG. 3, when the rotating shaft 21 is rotated in a direction, an outer surface of the first eccentric bush 42 in the first compression chamber 31 is eccentric from the rotating shaft 21, and the locking pin 80 is locked by either of the opposite ends of the locking slot 85. Thus, the first roller 37 is rotated while coming into contact with an inner surface of the first compression chamber 31, thus executing the compression operation in the first compression chamber 31. At this time, the second eccentric bush 52 is arranged in the second compression chamber 32, as illustrated in FIG. 4. That is, an outer surface of the second eccentric bush 52, which is eccentric in a direction opposite to the first eccentric bush 42, is concentric with the rotating shaft 21, and the second roller 38 is spaced apart from an inner surface of the second compression chamber 32, thus an idle rotation is executed in the second compression chamber 32. Further, when the compression operation is executed in the first compression chamber 31, the refrigerant is drawn into the inlet port 63 of the first compression chamber 31. In this case, the path control unit 70 controls the refrigerant intake path to draw the refrigerant into the first compression chamber 31.

The compressor of the present invention is operated as described above because the first and second eccentric cams 41 and 51 are eccentric from the rotating shaft 21 in a same direction while the first and second eccentric bushes 42 and 52 are eccentric from the rotating shaft 21 in opposite directions. That is, when a maximum eccentric part of the first eccentric cam 41 and a maximum eccentric part of the first eccentric bush 42 are arranged in a same direction, a maximum eccentric part of the second eccentric cam 51 and a maximum eccentric part of the second eccentric bush 52 are arranged in opposite directions, thus allowing the compressor of the present invention to be operated as described above.

Figure 7:
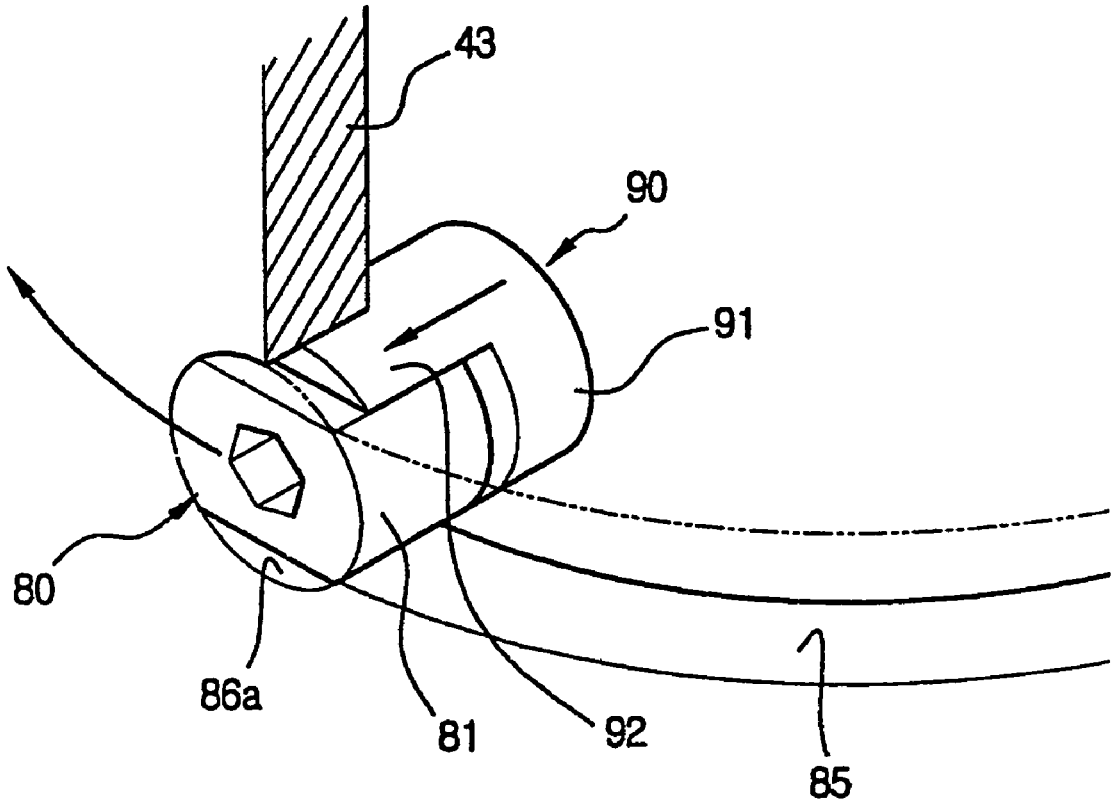
FIG. 7 is a perspective view illustrating a locking pin and a restraining unit of the variable capacity rotary compressor of FIG. 1, in which a connecting unit is restrained by the restraining unit.
Figure 10:
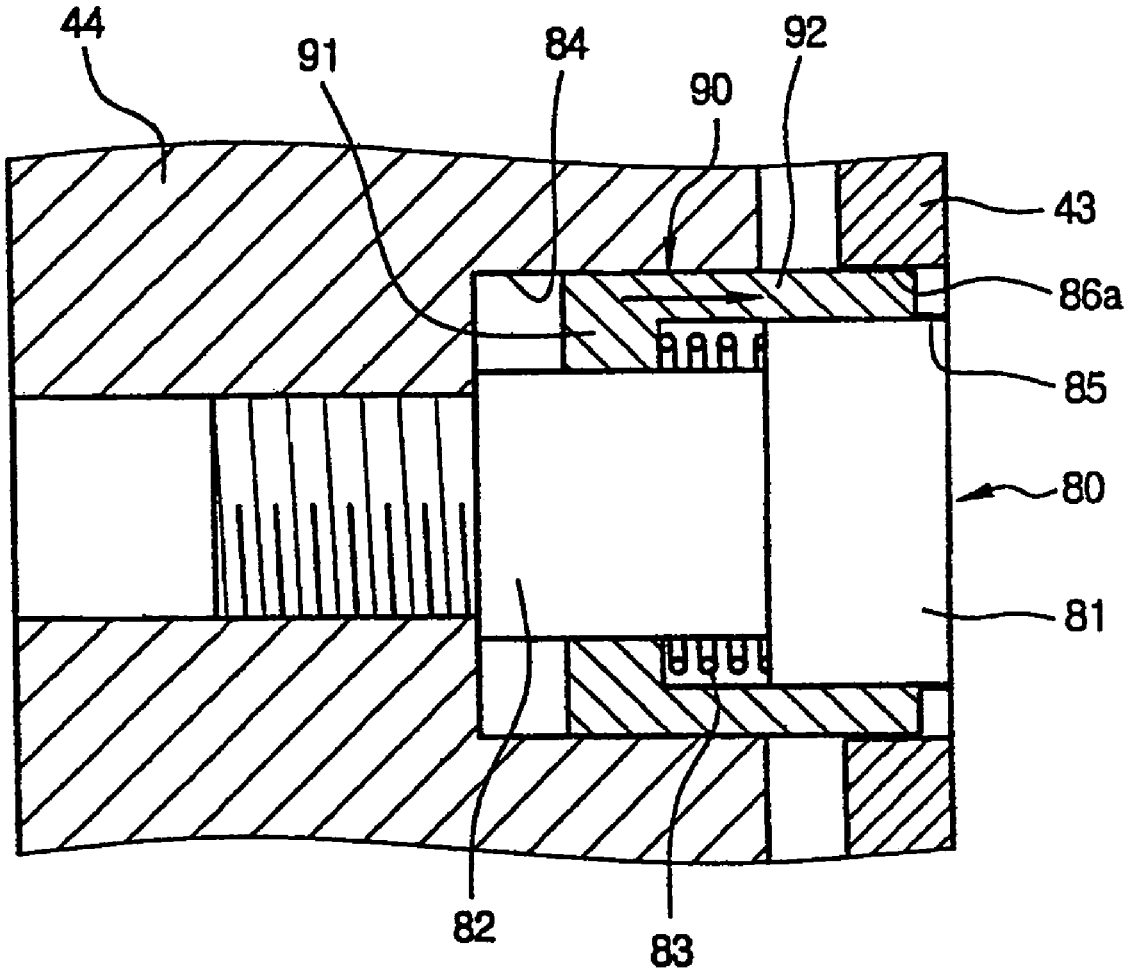
FIG. 10 is a sectional view illustrating the locking pin and the restraining unit of the variable capacity rotary compressor of FIG. 1, in which the connecting unit is restrained by the restraining unit.

When the compression operation is executed, as illustrated in FIGS. 7 and 10, the restraining unit 90 is outwardly projected from the rotating shaft 21 by the centrifugal force resulting from the rotation of the rotating shaft 21, and the extension parts 92 of the restraining unit 90 engage with the first restraining recess 86*a*, which is provided at the first end of the locking slot 85, thus restraining the connecting part 43. The restraining unit 90 functions to prevent the first and second eccentric bushes 42 and 52 from being rotated at a faster speed than the first and second eccentric cams 41 and 51, thus preventing the first and second eccentric bushes 42 and 52 from slipping, and preventing the locking pin 80 from colliding with one of the first and second ends of the locking slot 85. That is, according to a conventional variable capacity rotary compressor, when an eccentric bush of a compression chamber, where the compression operation is executed, is rotated toward an inlet port after passing an outlet port and a vane, some of compressed gas returns to the compression chamber without being discharged through the outlet port, and expands again. At this time, the eccentric bush is momentarily rotated at a faster speed than an associated eccentric cam, thus the eccentric bush slips over the eccentric cam. However, according to the present invention, the restraining unit 90 restrains the eccentric bushes 42 and 52, thus preventing slippage and collision from occurring, reducing noises, and enhancing durability and reliability.

Figure 8:
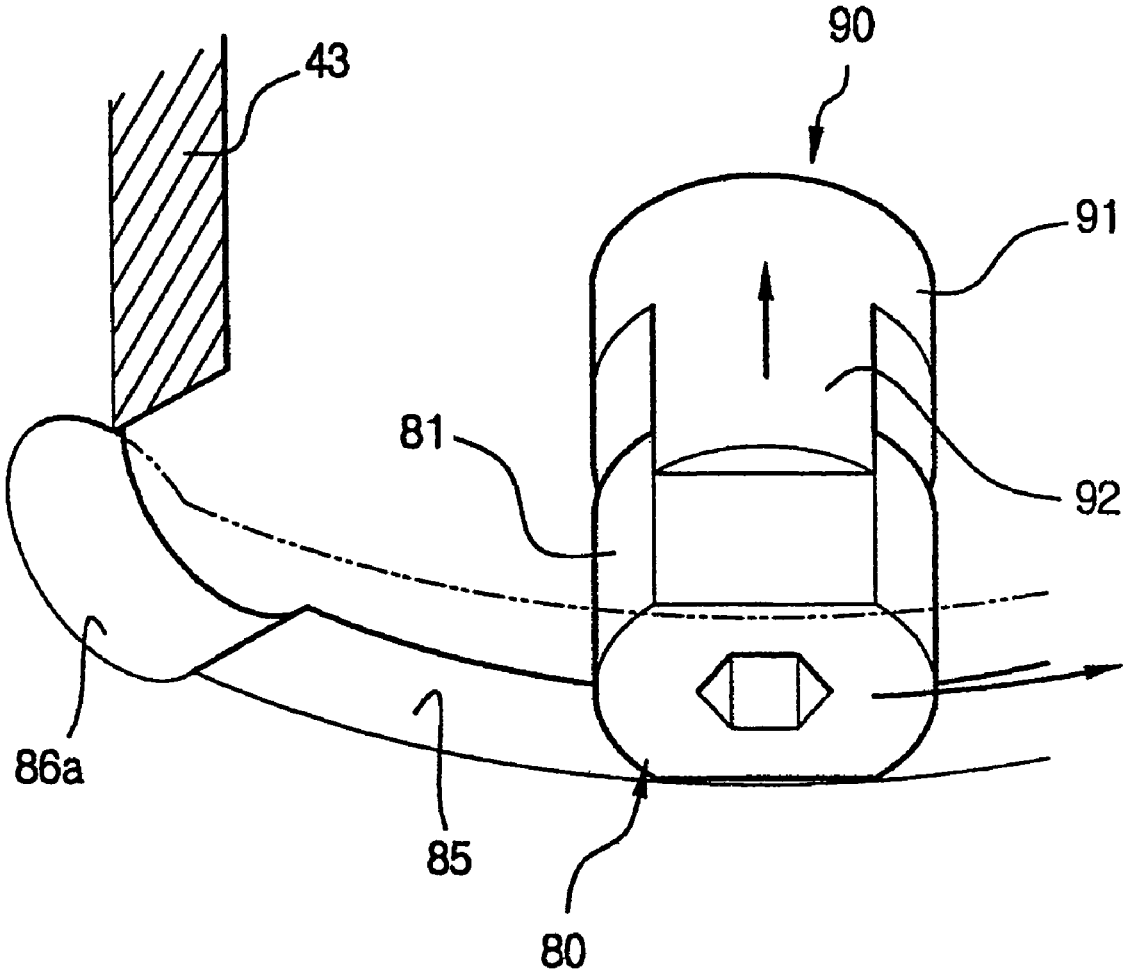
FIG. 8 is a perspective view illustrating the locking pin and the restraining unit of the variable capacity rotary compressor of FIG. 1, in which the connecting unit is released from the restraining unit.

When the compressor stops operating, as illustrated in FIG. 9, the restraining unit 90 moves into the eccentric part 44 by a restoring force of the return spring 83, thus releasing the first and second eccentric bushes 42 and 52. Meanwhile, in such a state, when the rotating shaft 21 is rotated in a direction opposite to the direction described above, the locking pin 80 is smoothly rotated within the locking slot 85, as illustrated in FIG. 8, because the restraining unit 90 is disengaged from the locking slot 85.

Figure 5:
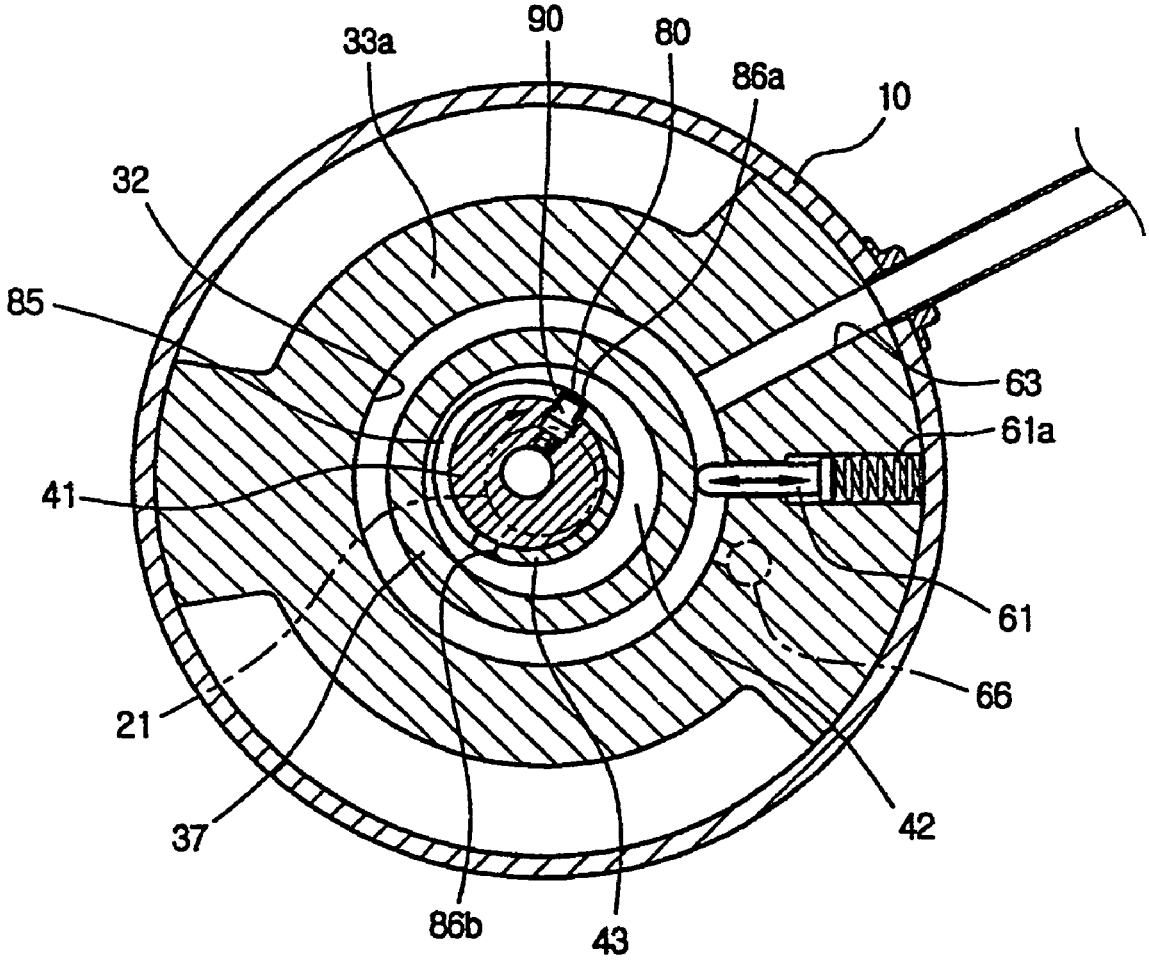
FIG. 5 is a sectional view illustrating an idle operation of the first compression chamber, when the rotating shaft of the variable capacity rotary compressor of FIG. 1 is rotated in a second direction.
Figure 6:
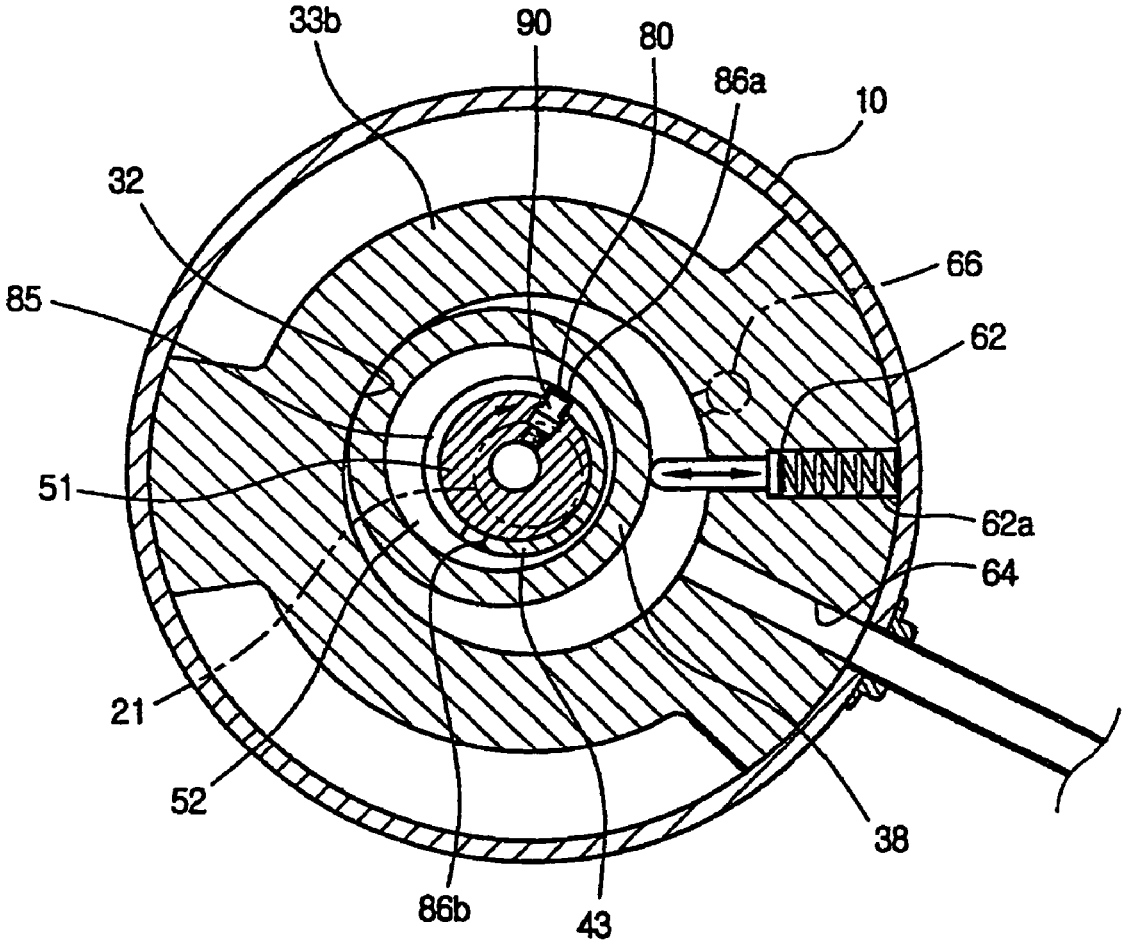
FIG. 6 is a sectional view illustrating a compression operation of the second compression chamber, when the rotating shaft of the variable capacity rotary compressor of FIG. 1 is rotated in the second direction.

When the rotating shaft 21 is rotated in a direction opposite to the direction as described in FIG. 3 to execute the compression operation, the outer surface of the first eccentric bush 42 in the first compression chamber 31 is released from eccentricity from the rotating shaft 21, and the locking pin 80 engages with either of the opposite ends of the locking slot 85, as illustrated in FIG. 5. At this time, the first roller 37 is rotated while being spaced apart from the inner surface of the first compression chamber 31, thus the idle rotation is executed in the first compression chamber 31. Meanwhile, the outer surface of the second eccentric bush 52 in the second compression chamber 32 is eccentric from the rotating shaft 21, and the second roller 38 is rotated while being in contact with the inner surface of the second compression chamber 32, as illustrated in FIG. 6. At this time, the compression operation is executed in the second compression chamber 32.

When the compression operation is executed in the second compression chamber 32, the refrigerant is drawn into the inlet port 64 of the second compression chamber 32. Thus, the path control unit 70 controls the refrigerant intake path to draw the refrigerant into the second compression chamber 32. Further, the restraining unit 90 is outwardly projected from the rotating shaft 21 by the centrifugal force when the rotating shaft 21 is rotated. At this time, the restraining unit 90 is locked by the second restraining recess 86*b* of the locking slot 85, thus restraining the connecting part 43.

Figure 12:
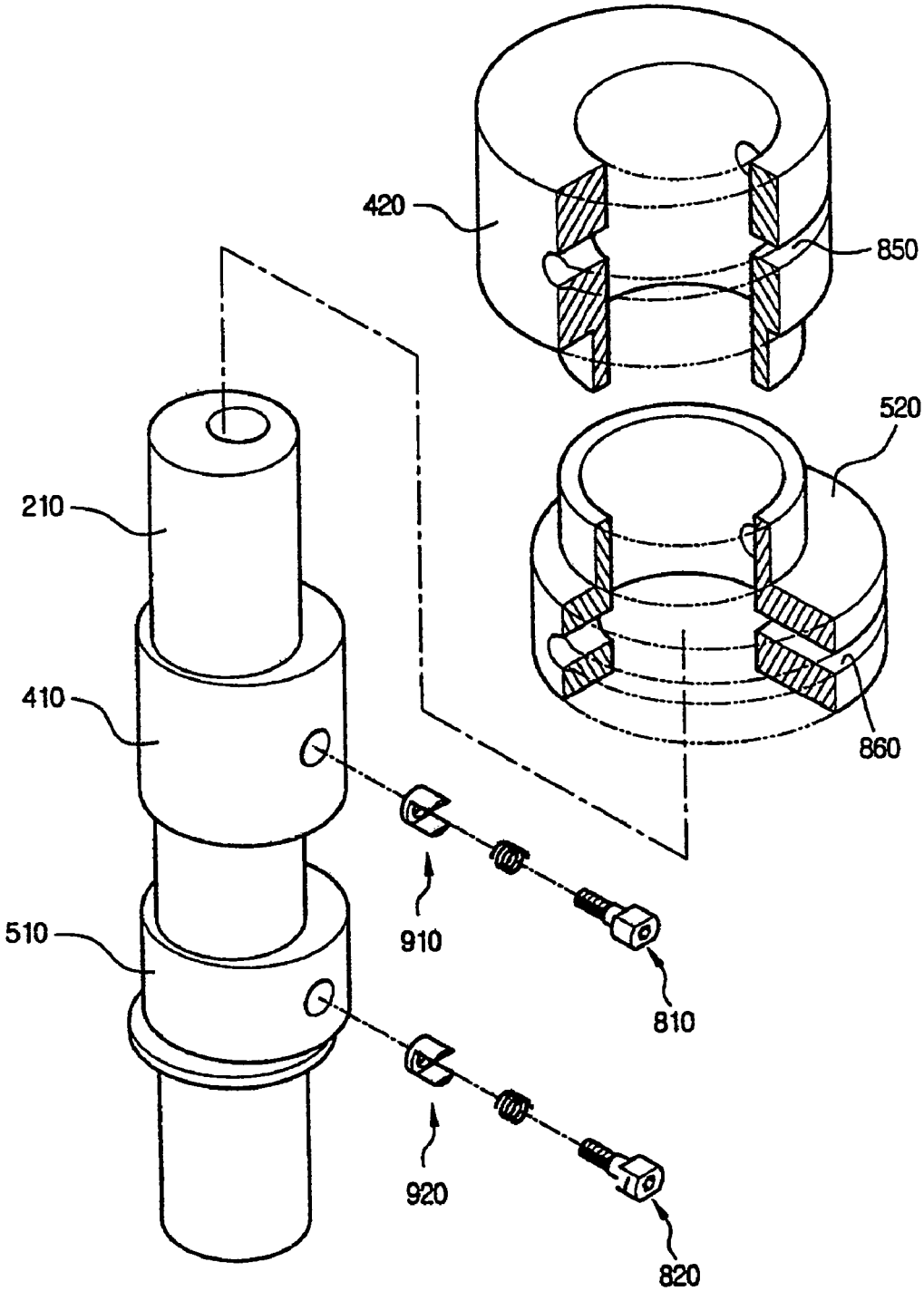
FIG. 12 is an exploded perspective view of an eccentric unit included in a variable capacity rotary compressor, according to another embodiment of the present invention.

FIG. 12 is an exploded perspective view of an eccentric unit included in a variable capacity rotary compressor, according to another embodiment of the present invention. In the variable capacity rotary compressor of FIG. 12, first and second eccentric bushes 420 and 520 are separated from each other, and a first locking pin 810 and a first restraining unit 910 to lock and restrain the first eccentric bush 420 are provided separately from a second locking pin 820 and a second restraining unit 920 to lock and restrain the second eccentric bush 520. That is, a first locking slot 850, having restraining recesses at opposite ends thereof, is provided around a part of the first eccentric bush 420, and the first locking pin 810 and the first restraining unit 910 are mounted to the first eccentric cam 410. Further, a second locking slot 860, having restraining recesses at opposite ends thereof, is provided around a part of the second eccentric bush 520, and the second locking pin 820 and the second restraining unit 920 are mounted to the second eccentric cam 510. The general shape of the variable capacity rotary compressor of FIG. 12 remains the same as the variable capacity rotary compressor of FIGS. 1 through 11. In FIG. 12, the first and second eccentric cams 410 and 510 are mounted to a rotating shaft 210 to be eccentric from the rotating shaft 210 in a same direction. Further, the first locking pin 810 and the first restraining unit 910, as well as the second locking pin 820 and the second restraining units 920 are installed to be placed along a same axial position. Alternatively, the first and second eccentric cams 410 and 510 may be installed to be eccentric from the rotating shaft 210 in opposite directions. Further, the first locking pin 810 and the first restraining unit 910 may be installed in a direction opposite to the second locking pin 820 and the second restraining unit 920.

As is apparent from the above description, the present invention provides a variable capacity rotary compressor, which is designed to execute a compression operation in either of first and second compression chambers having different capacities by eccentric units which rotates in the first or second direction, thus varying a compression capacity of the compressor as desired.

Further, the present invention provides a variable capacity rotary compressor, which is designed to make a restraining unit be outwardly projected from an eccentric part by a centrifugal force when the rotating shaft is rotated to execute a compression operation, thus restraining eccentric bushes to prevent the eccentric bushes from slipping, and reducing noise while enhancing durability and reliability.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A variable capacity rotary compressor, comprising:

a housing to define first and second compression chambers having different capacities therein;

a rotating shaft to be placed in the first and second compression chambers;

first and second eccentric cams mounted to the rotating shaft, to be placed in the first and second compression chambers, respectively;

first and second eccentric bushes to rotatably fit over the first and second eccentric cams, respectively;

a cylindrical connecting part to integrally connect the first and second eccentric bushes to each other, with a locking slot being provided around the connecting part;

a locking pin mounted to the rotating shaft, to project from the rotating shaft, and locked by either of first and second ends of the locking slot, according to a rotating direction of the rotating shaft, making one of the first and second eccentric bushes eccentric from the rotating shaft while making a remaining one of the first and second eccentric bushes be released from eccentricity from the rotating shaft, the first and second eccentric bushes being eccentric in opposite directions; and a restraining unit to fit over the locking pin, to be reciprocated in a radial direction of the rotating shaft, the restraining unit outwardly moving from the rotating shaft by a centrifugal force when the rotating shaft is rotated, and being stopped by either of the first and second ends of the locking slot to restrain the connecting part.

2. The rotary compressor according to claim 1, wherein: the locking pin comprises:

a head part to engage with the locking slot; and a locking part to extend from the head part, to be mounted to the rotating shaft, and having a smaller diameter than the head part, and the restraining unit comprises:

a support part to fit over the locking part of the locking pin, to be reciprocated in the radial direction of the rotating shaft; and an extension part to outwardly extend from the support part in the radial direction of the rotating shaft, to cover an outer surface of the head part of the locking pin, and to enter the locking slot.

3. The rotary compressor according to claim 2, wherein: the extension part extends from upper and lower portions of the support part, to cover upper and lower surfaces of the head part of the locking pin, and the locking slot has a width to correspond to a width of the head part, with a restraining recess being provided at each of the first and second ends of the locking slot, to have a depth to correspond to a thickness of the extension part, causing the extension part to be stopped within the restraining recess.

4. The rotary compressor according to claim 3, wherein an outer surface of the extension part has a curved surface to correspond to an inner surface of the restraining recess.

5. The rotary compressor according to claim 3, further comprising:

a return spring to fit over the locking part of the locking pin, and to bias the restraining unit toward a central axis of the rotating shaft when the rotating shaft is stopped, releasing the connecting part.

6. The rotary compressor according to claim 5, wherein the return spring is supported at a first end thereof by the head part of the locking pin, and at a second end by the support part of the restraining unit, to allow the restraining unit to be biased toward the central axis of the rotating shaft.

7. The rotary compressor according to claim 6, wherein when the rotating shaft stops rotating and the centrifugal force stops, the extension part of the restraining unit is disengaged from the restraining recess by a restoring force of the return spring, releasing the cylindrical connecting part.

8. The rotary compressor according to claim 3, further comprising:

a magnet included in the rotating shaft, to bias the restraining unit toward a central axis of the rotating shaft when the rotating shaft is stopped, releasing the connecting part.

9. The rotary compressor according to claim 1, further comprising:

a locking hole provided at a predetermined position of the rotating shaft, to movably receive the restraining unit therein.

10. The rotary compressor according to claim 9, further comprising:

a magnet at a position inside the locking hole, to bias the restraining unit toward a central axis of the rotating shaft when the rotating shaft is stopped, releasing the connecting part.

11. The rotary compressor according to claim 10, wherein when the centrifugal force increases by the rotation of the rotating shaft, the restraining unit is pulled away from the magnet and moves outwardly in the radial direction of the rotating shaft, restraining the cylindrical connecting part.

12. The rotary compressor according to claim 1, further comprising:

a return spring included in the rotating shaft, to bias the restraining unit toward a central axis of the rotating shaft when the rotating shaft is stopped, releasing the connecting part.

13. The rotary compressor according to claim 1, further comprising:

an eccentric part having a same shape as the eccentric cams, and provided on an outer surface of the rotating shaft inside the connecting part, to mount the locking pin and the restraining unit to the rotating shaft.

14. A variable capacity rotary compressor including a housing to define first and second compression chambers having different capacities therein, the compressor comprising:

a rotating shaft to be placed in the first and second compression chambers;

a restraining unit outwardly projected from the rotating shaft by a centrifugal force when the rotating shaft is rotated to execute a compression operation, restraining first and second eccentric bushes provided in the compressor to prevent the first and second eccentric bushes from slipping; and a locking pin mounted to the rotating shaft to project from the rotating shaft and to make one of the first and second eccentric bushes eccentric from the rotating shaft while making a remaining one of the first and second eccentric bushes be released from eccentricity from the rotating shaft, wherein the restraining unit fits over the locking pin.

* * * * *